US009821308B2

(12) United States Patent
Comanns et al.

(10) Patent No.: US 9,821,308 B2
(45) Date of Patent: Nov. 21, 2017

(54) DEVICE FOR THE CAPILLARY TRANSPORT OF LIQUIDS

(71) Applicant: FRAUNHOFER-GESELLSCHAFT ZUR FOERDERUNG DER ANGEWANDTEN FORSCHUNG E.V., Munich (DE)

(72) Inventors: Philipp Comanns, Aachen (DE); Werner Baumgartner, Monschau (DE); Frank Bernhardt, Aachen (DE); Kai Winands, Aachen (DE); Kristian Arntz, Wuerselen (DE)

(73) Assignee: Fraunhofer-Gesellschaft zur Foerderung der angewandten Forschung e.v. (DE)

( * ) Notice: Subject to any disclaimer, the term of this patent is extended or adjusted under 35 U.S.C. 154(b) by 213 days.

(21) Appl. No.: 14/392,003

(22) PCT Filed: Jun. 28, 2013

(86) PCT No.: PCT/DE2013/100234
§ 371 (c)(1),
(2) Date: Dec. 29, 2014

(87) PCT Pub. No.: WO2014/000735
PCT Pub. Date: Jan. 3, 2014

(65) Prior Publication Data

US 2016/0167043 A1 Jun. 16, 2016

(30) Foreign Application Priority Data

Jun. 28, 2012 (DE) ..... 10 2012 012 884
Nov. 6, 2012 (DE) ..... 10 2012 021 603

(51) Int. Cl.
*B01L 3/00* (2006.01)
*F04B 19/00* (2006.01)
*F04F 7/00* (2006.01)

(52) U.S. Cl.
CPC ..... *B01L 3/5027* (2013.01); *F04B 19/006* (2013.01); *F04F 7/00* (2013.01); *B01L 2400/0406* (2013.01)

(58) Field of Classification Search
CPC ..... B01L 3/5027; B01L 2400/0406; F04B 19/006
See application file for complete search history.

(56) References Cited

U.S. PATENT DOCUMENTS

2005/0106752 A1* 5/2005 Yu ..... B01J 19/0093 436/174
2007/0006926 A1* 1/2007 Prakash ..... F15C 1/00 137/800

* cited by examiner

*Primary Examiner* — Sam P Siefke
(74) *Attorney, Agent, or Firm* — David C. Purdue

(57) ABSTRACT

Disclosed is a device for the directed capillary transport of liquids, comprising at least two capillaries (8, 9, 33, 54, 55), the at least two capillaries (8, 9, 33, 54, 55) being designed such that the liquid can be transported in at least some regions in a passive, directed and capillary manner, characterised in that at least two of the capillaries (8, 9, 33, 54, 55) are interconnected in the direction of transport of the liquid via at least one capillary passage conduit (20, 23, 28, 29, 34, 40, 41, 59, 63). The invention is intended for use in the separation of components from a fluidic substance and/or in oil/water separation. A production method is characterised in that at least one part of the capillary structure is generated by means of laser irradiation, by means of a moulding tool, in particular a sintering mould, by means of a milling process, in particular by means of a micro-milling process, or by means of EDM.

20 Claims, 5 Drawing Sheets

DEVICE FOR THE CAPILLARY TRANSPORT OF LIQUIDS

Figure 1:
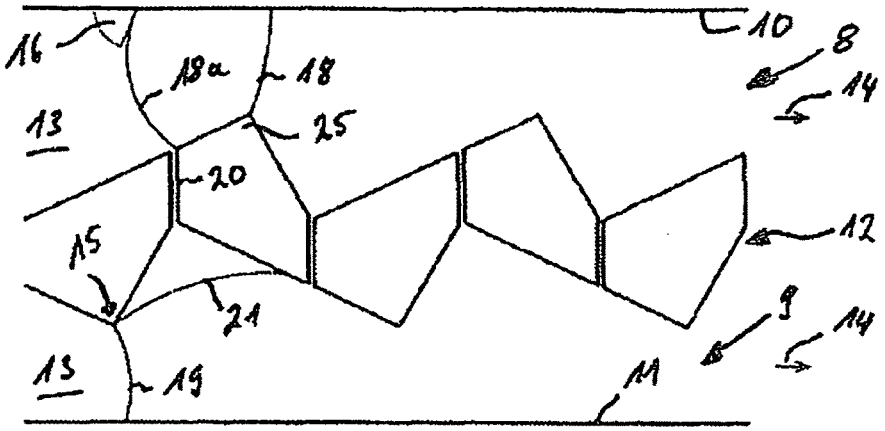

The invention relates to a device for the capillary transport of liquids, to the use of such a device and to a method for producing such a device.

A capillary is a cavity in which, when there is liquid therein, surface effects can dominate over the effects of viscosity and inertia. Using this particular feature, capillaries are used in various procedures to process liquids, to investigate them or indeed to transport them in a controlled manner. Capillaries are also used in capillary pumps for autonomous microfluidic systems (M. Zimmermann et al.; Capillary pumps for autonomous capillary systems; Lab Chip 2007, 7, 119-125).

Capillaries may be of closed or partially open form. In a closed capillary, the direction of transport of the liquid is determined by the orientation of the capillary. The transport effect is a consequence of the surface tension of the liquid in the capillary and the interfacial tension produced between the liquid and the solid surface of the capillary. Furthermore, surface friction also plays a part. The liquid rises in a capillary until the capillary force is equal to the opposing gravitational force of the liquid. Here, the level to which the liquid rises is dependent on the properties of the capillary (e.g. material parameters, cross section of the capillary) and of the liquid (e.g. contact angle, surface tension). Mathematical models for closed capillaries having a round cross section are typically based on the Lukas-Washburn equation or modifications thereof. For closed capillaries having a rectangular cross section, a hydraulic radius is applied. For capillaries whereof the round cross section varies in certain regions, Young (2004) has modeled capillary liquid transport using the Lukas-Washburn equation.

The term "partially open capillaries" is used to describe for example those in the form of cavities between two parallel plates. Furthermore, there are also channel-shaped capillaries whereof the cross section is for example in the shape of a v or in the shape of a u.

A device of the type mentioned at the outset is known from EP 2 339 184 A2, which discloses a device for transporting liquids in the vertical or horizontal direction, in which partially open capillaries are used, wherein different contact angles between the liquid and the surface of the respective capillary are used to form a hydrodynamic force which controls the transport of liquid. Here, consumption from sources of external energy is to be minimized. Channels are described whereof the inner surface is divided into regions of different chemical compositions, which consequently have different contact angles or contact angle gradients. Such chemical heterogeneities in the contact angles may be arranged in an annular or helical arrangement and enable drops of liquid to be transported. The heterogeneities in the contact angles may also be produced by a sawtooth-shaped geometry on the inner side or by annular or helical protuberances. Any points of discontinuity may be overcome by the supply of external energy.

WO 2006/121534A1 discloses a capillary having an asymmetric internal surface structure similar to a sawtooth. The asymmetry refers to an axis of symmetry perpendicular to the capillary surface. The transport of liquid which is disclosed, and which is not mechanical, is based on the Leidenfrost effect and must be driven by thermal means.

A. Buguin (Ratchet-like topological structures for the control of microdrops; Appl. Phys. A 75,207-212 (2202)) also describes a directed movement of drops in a sawtooth channel, though this is driven by an electrical field or by vibration.

WO 2007/035511A2 also discloses capillaries having an asymmetric internal surface structure which, if there is a drop therein, produces a resultant force. Similarly, additional energy, for example a fluid pressure, is required for transporting the drop in order to overcome the force of resistance caused by roughness of the surface structure.

WO 2008/114.063A1 discloses closed capillaries having a width to depth ratio of 10 to 100, in which at least one of four side walls has the function of reducing speed and is micro-structured for this purpose.

In microfluidics, non-capillary surface structures are used to reduce the flow rate in the marginal region and hence to produce homogeneous flow in wide capillaries. This is disclosed in EP 1 201 304 B1. Non-capillary surface structures are also known from WO 2007/035511A2, already cited above.

Furthermore, C. W. Extrand (Retention Forces of a Liquid Slug in a Rough Capillary Tube with Symmetric or Asymmetric Features; Langmuir 2007, 23, 1867-1871) discusses the actions of surface structures, in particular asymmetric surface structures in capillaries, on liquids. It is stated that a drop enclosed in an appropriate capillary can only be moved once a critical level of external force is applied. Different contact angles may also be influenced to a substantial extent with a drop on a surface by heterogeneities or roughness. Thus, this can bring about anisotropic spreading of applied drops.

In "Moisture harvesting and water transport through specialized micro-structures on the integument of lizards" (Beilstein J. Nanotechnology. 2: 204-214; http://www.ncbi.nlm.nih.gov/pmc/articles/PMC3148043/), Comanns et al. describe various lizard species which are capable of absorbing, through their skin, liquid from the environment, in particular from humidity in the air, fog, rain or moist soil, and distributing the absorbed liquid by means of partially open capillary structures located in the scales of the lizard's skin. In this regard, one of the lizard species (Phrynosoma cornutum) does not display an even dispersion of the liquid over the entire skin but a directed transport of liquid toward the mouth. The paper does not disclose which particular features of the lizard's skin are responsible for the directed transport.

DE 103 09 695 A1 discloses a method for connecting plastic tubes for producing capillary tube mats, in which a mold is used by means of which the internal cross section of a closed capillary tube that is to be welded to a collecting tube can be molded.

DE 10 2009 038 019 A1 discloses methods for producing channel structures for a bioreactor using punching methods, laser ablation methods, stamping methods or micro-milling methods.

EP 0 058 019 A2 discloses a mold for molding a of spinneret capillary, in which electrical discharge machining is used to form the spinneret opening.

It is known from WO 2005/094982 A2 to use laser cutting, laser ablation, roll forming or electrical discharge machining or photochemical removal for producing capillary structures of a micro-channel device.

The above-mentioned prior art substantially relates to undirected spreading or the directed transport of individual drops of liquid. Thus, it relates to the transport of very small quantities of liquid over typically short transport distances. Hitherto, however, it has not been possible to transport liquids on surfaces or in materials having capillary properties both by capillary means and solely or at least predominantly in a particular direction from a given position. In partially open capillary systems, approaches relating to this are existing in microfluidics, but because of the small range of sizes these are only applicable to a very restricted extent and moreover are susceptible to wear.

The technical problem underlying the invention concerned here is to provide a device of the type mentioned at the outset by means of which capillary liquid transport can be made more rapid and more selective in terms of direction. Furthermore, uses of the device and methods for producing such a device are to be proposed.

In the case of a device of the type mentioned at the outset, the technical problem is solved by the present invention.

According to the present invention, the directed transport of liquid, which is passive—that is to say is not supplied with external force—in the capillary is based on the tact that at least two of the capillaries are connected to one another in the direction of transport of the liquid by way of at least one capillary passage channel. A passage channel that connects the capillaries represents a functional connection which is formed such that any local stoppage that occurs in the liquid to be transported. in the one capillary is overcome by the supply of liquid by way of the passage channel from the other capillary. Preferably, the capillaries are connected to one another by way of a plurality of passage channels, that is to say by way of at least two, more preferably at least three, more preferably at least five, more preferably at least ten, passage channels.

The passage channel, which is also capillary in nature, provides for the formation of a further liquid front which is connected to the stopped liquid front, and in this way. produces a new overall liquid front which moves on in a passively directed manner, at least over a certain distance. In the text below, liquid fronts are also called menisci.

Since the capillaries are connected to one another by way of the passage channels, which may vary in cross section, and are thus a communicating system, the overall structure formed by capillaries and passage channels forms a common capillary structure whereof the capillaries as defined in the claim are a part as a sub-structure. The term "passage channels" in the context of the invention is understood to mean the regions of the capillary structure in which an additional meniscus is formed in order to transport liquid from one capillary to the other. In each case, the passage channel ends where a meniscus is combined with a meniscus of the capillary provided.

The device according to the invention may be formed such that the at least two capillaries each have a plurality of transport sections which, as seen in the direction of transport, succeed one another and are set up for passive directed capillary transport. The transport sections each end in a stop point which is suitable for interrupting the unimpeded passive directed transport of liquid. The passage channels each have a channel outlet close to the stop point, in particular downstream of the stop point as seen in the direction of transport, and adjoining the stop point, such that the meniscus of the passage channel and that of the capillary to be provided are combined. The meniscus of the capillary may also already end before the stop point, in the forward direction. If the spacing from the stop point is sufficiently small, it is equally possible for the menisci to be combined.

If the structure comprising capillaries and passage channel is repeated successively, it is possible to achieve liquid transport over a corresponding distance. In this case, the capillaries which are connected to one another by way of the passage channels alternately supply one another with the liquid required for overcoming a stop point for continued capillary transport. The stop point may for example be an edge in a wall structure of the capillary.

The term "directed transport" means that there is at least one preferred direction for transport. Thus, the capillary system may for example perform transport in a forward direction, but completely prevent any backward transport in opposition thereto. However, directed transport also includes a variant in which, in addition to forward transport, backwardly directed transport may also take place which, however, is slower than forward transport. Asymmetrical transport performed in different directions is in particular possible if the capillary system is fed from a liquid source, for example a drop thereon.

Moreover, directed transport includes multidimensional systems in which the liquid transport can branch, that is to say in which there are more than two capillaries which extend in different directions in two dimensions or three dimensions, and liquid transport is performed more rapidly in preferred directions and is carried out more slowly in other directions of the capillary runs or is prevented.

Directed transport furthermore includes variants in which rear menisci are drawn along in a preferred direction.

For two capillaries which are connected to one another by way of passage channels, the sequence of events is for example as follows. In the first capillary, the liquid forms a first meniscus, which as a result of capillary forces progresses until it comes to a stop in the region of a first stop point. Downstream of the stop point, as seen in the direction of flow, the following transport section is supplied with liquid from the second capillary by way of at least one of the passage channels, in which a further meniscus is formed. This is possible because liquid transport has also taken place in the second capillary, and some of the liquid of the second capillary has entered the inlet of the passage channel. The further meniscus of the passage channel is combined, at the outlet of the passage channel, with the first meniscus, which is at the stop point or in the vicinity thereof, to form a common meniscus which overcomes the stop point, such that directed transport is continued in the transport section of the first capillary downstream of the stop point until the region of a second stop point is reached. On the way to the second stop point, the liquid of the first capillary passes the inlet of at least one further passage channel, which then correspondingly supplies the second capillary with liquid in order to overcome a stop in the liquid transport at that point.

This principle may also be realized in an interaction between more than two capillaries, for example in that three or more capillaries are mutually connected by passage channels. This may also be realized such that a first passage channel connects a first and a second capillary, a second passage channel connects the second and a third capillary, and a third passage channel connects the third capillary to the first capillary again. This principle may be further extended.

It is also conceivable for a capillary to be connected to two or more capillaries by way of passage channels.

In this way, directed transport of the liquid which is passive, that is to say is produced without the use of external energy sources, is possible.

Using the structure, a preferred direction of liquid transport can be realized such that the transport is directed. For this purpose, the structure of the capillaries may be formed such that the effect of passive transport by means of the passage channels which is described above is only achieved in a particular direction of the run of the capillaries involved. The structure of the capillaries is in this case asymmetric in form such that, in a direction opposed to the desired direction of transport, the further menisci formed there stop without reaching the passage channel which is required to fill the cavity of the adjoining capillary which succeeds the respective meniscus. The structures are selected such that the menisci that are directed backward, that is to say in opposition to the desired direction of transport, have a markedly smaller curvature or adopt a straight or convex (outwardly curved) shape.

As an alternative to stopping the rear meniscus in the direction opposed to the direction of transport, the rear meniscus may for example also be transported more slowly, which results in asymmetric transport of the liquid. In this case, the rear meniscus in the capillaries preferably has a slightly concave shape or has at least a smaller curvature than one of the front menisci in the capillaries.

The desired action of the transport sections, of transporting liquid in directed manner by means of capillary force passively, that is to say without the action of an external force may for example be achieved by a suitable geometry of the capillaries. For this, it may for example be provided for the transport sections to have a cross section which is reduced in the direction transport. Downstream of a transport section, the cross section may widen again, preferably with the cross section widening abruptly and non-constantly, such that a new transport section of reducing cross section may adjoin it.

The action of the transport sections may also be achieved by the material of the inner surfaces of the capillary, for example by suitable coatings or by micro-structuring or nano-structuring.

A stop point may for example be formed by a widening in the cross section of the capillary. As an alternative, a stop point may also be achieved by a change in the surface material or the surface structure, for example the roughness, at least in one part region of the capillary wall. The capillary wall may be round in cross section or may have any desired shape of cross section and include for example floor and/or side walls.

Passively directed transport of the liquid may be achieved both with closed and with partially open capillaries. The term "closed capillaries" means those capillaries which, apart from inlets or outlets of passage channels which pass through the periphery and connect capillaries, are closed over the entire periphery. Any capillaries which are not closed, that is to say those which are produced by two parallel or largely parallel plates and have a u-shaped or v-shaped cross section or cross sections of irregular shape and are open in at least one longitudinal direction, are partially open.

If for example liquid is put onto a structure having partially open capillaries, for example in the form of a drop which is large by comparison with the diameter of the capillaries or by way of another liquid source, there are formed front menisci, as seen in the direction of transport, and rear menisci in the backward direction. The front menisci continue to move in the direction of transport in the manner described above, merely as a result of capillary forces, while the rear menisci, in the backward direction, stop at the latest at a stop point unless other external forces overcome this, but at least in relation to the speed of the front menisci are markedly slower. Movement of the front menisci in the direction of transport continues as long as the source of liquid is fed to the capillaries.

Once liquid is no longer supplied, either further movement in the direction of transport is stopped or the rear menisci are drawn along in the direction of transport, with the result that the entire mass of liquid is moved in directed manner as a result of the capillary forces. The behavior depends on the existing forces at the interfaces, on frictional forces and where appropriate external forces such as the force of gravity.

Correspondingly, the movement behavior may depend on supply from a liquid source in closed capillaries as well.

Capillaries may extend along a planar or curved surface or be produced in three dimensions, and for example have a sponge-like structure.

Capillaries according to the invention may also be formed by fiber material, for example comprising solid fibers or hollow fibers. Hollow fibers may themselves form closed capillaries. However, a hollow fiber may also include a first inner structure which may also be fibrous. This inner structure may appear on the surface regularly or irregularly.

The device according to the invention may also be a textile, for example for clothing, sports equipment, structural textiles, sanitary articles such as diapers or bandages, or other textiles which collect liquid, for example for absorbing oil.

In an advantageous embodiment, the device according to the invention. may be part of a. tool, in particular a machine tool. The capillaries located thereon may in particular serve to supply liquid, for example coolant, lubricant or cooling lubricant, to a location for machining. Closed or partially open capillaries may be provided for this purpose. In this way, the liquid may be introduced into a supply region a few millimeters away from the cutting edge. As a result of this, the quantity of liquid may be reduced. Furthermore, the energy for supplying the liquid may be reduced.

The device according to the invention may also be a mold. In the case of shaping or casting from a mold, in particular in the sector of aluminum die casting, the faultless removal of a component from a mold is a decisive step in the procedure. For this purpose, a large quantity of parting agent is often used to avoid inadequate wetting of the mold. The use of resources may be markedly reduced if the mold is provided with capillaries for wetting. Moreover, the effectiveness and action of wetting may also be increased.

The device according to the invention may advantageously also be a means for the metered supply of liquid in further applications, in particular for transporting solder material when soldering electronic components. The quantity of solder may be metered appropriately to the application in order to achieve an optimum result when the conductor tracks are brought into contact with the solder. For this purpose, the baseplates are structured with capillaries before contact is made.

Furthermore, the device according to the invention may be a sensor. As a result of the possibility of directed transport, liquids may be supplied to a sensor system. Here, it is possible to split liquids as a result of the defined construction of the capillaries and to divide them into individual components. In the case of blood, for example, this may be the separation of blood plasma and blood cells. During the flow movement, the micro-structuring of the capillaries resulting from the given geometry may either guide the components into different channels or act as a kind of particle trap in which the particles, for example the blood cells, are caught but the rest of the liquid continues to flow. Thus, in this way the capillaries would function as a filter. Here, it is conceivable to arrange a plurality of such structured fields one next to the other, for example in the manner of a cascade, in order to produce filter stages. In this way, a fluid could be split into not only two components (for example into a liquid and a solid part), but where applicable it would also be possible to separate different liquids and at the same time different solids from one another and even to divert them into different component regions.

The device according to the invention may also serve as a moisture sensor. In various engineering sectors, precipitation of moisture and in some cases also the formation of ice associated therewith, for example in the aerospace sector, are a critical aspect. Thus, a device according to the invention may be formed such that the capillary micro-structures allow moisture from the environment, for example the air, to condense on the sensor and guide it in a controlled manner to a region of the sensor in order there to analyze the level of relative humidity or to detect the onset of ice formation by determining the quantity of flow. A further use of the condensation effect would be the removal of moisture from internal spaces, particularly including internal spaces of technical equipment such as refrigerators, in order to prevent foods from spoiling too quickly because of a high level of relative humidity, or indeed electronic switch cabinets, in which high relative humidity can result in short circuits and damage. The capillary surface structures could trigger condensation and guide the condensate away to a reservoir in a controlled manner.

The device according to the invention may be used to separate components from a fluid substance. In particular, it may also be used to separate oil and water. This may advantageously be applied in brake systems and stores or in process engineering plant, for example to prepare brake fluids and hydraulic oils or to clean reservoirs in the event of contamination.

The device according to the invention may also be a structure that is used for heat exchange or heat removal. For example, distillers, which are installed in process engineering plant for this purpose, are often made of copper. The surfaces may readily be suitably provided with the capillary structures. As a result, the surface is on the one hand made quantitatively larger and on the other the suitable capillary structures may have a controlled influence on liquid transport to increase the cooling effect or the heat exchange.

The capillary structures of the device according to the invention may be produced by different reductive or generative methods, for example mechanically, e.g. by milling machining, in particular by micro-milling, thermally, e.g. by machining laser removal, chemically, e.g. by etching, electrically, e.g. by erosion, or by a combination of these mechanisms, e.g. electrochemical electrical procedures, as in an ECM procedure.

Further methods for producing capillary structures are shaping methods, such as stamping, in which the capillary structures are produced by crowding or displacing material, or methods of primary forming, e.g. injection molding or die casting, in which the capillary structures are produced by replicating them from shaping contours in molds, or directly by building them up in generative methods.

Furthermore, capillary structures may be produced by processing material fibers, e.g. solid material fibers, hybrid material fibers or by a combination using additional encasing hollow fibers and by producing for example fiber braids, fibrous fabrics, fiberwoven fabrics, fibrous knitted fabrics or fibrous knitted goods.

The devices according to the invention may be made from various materials or be composed of different materials, with these materials preferably being metals, metal alloys, hard metals or carbides, polymer-based or mineral-based materials, glass, composite materials or ceramics.

Production of the capillary structures may also be coupled with production of the device itself, with the result that a separate production step is not required. This is particularly useful in connection with devices having a capillary structure that are made from fibers or fiber-like materials. Thus, the capillary structure may be incorporated during the production of fibers, of a part which is functionally coupled to the fiber, of a textile or of a polymer-based, foamed or porous material. In this case, each individual fiber may itself have a capillary structure or for example the fiber composite may form the capillary structure as a whole.

To produce the device according to the invention, particularly advantageously laser radiation may be used. As a result of this, extremely fine capillary structures may be made in surfaces in an effective manner, these typically being partially open capillaries.

However, depending on the application, producing the capillary structures by means of laser radiation may represent a complex and costly measure. As an alternative, it is conceivable to produce partially open surface capillaries with the aid of a molding procedure, wherein the negative structures of the capillaries form part of the mold to be copied, in the manner of a web. In the case of carbide tool tips, in particular throw-away tool tips that are produced by a sintering procedure, the negative structures may be incorporated into the sintering mold. This may in turn preferably be done with the aid of laser radiation, since the sintering mold can be used multiple times.

Preferred structures for devices according to the invention will be explained below with reference to figures.

Figure 2:
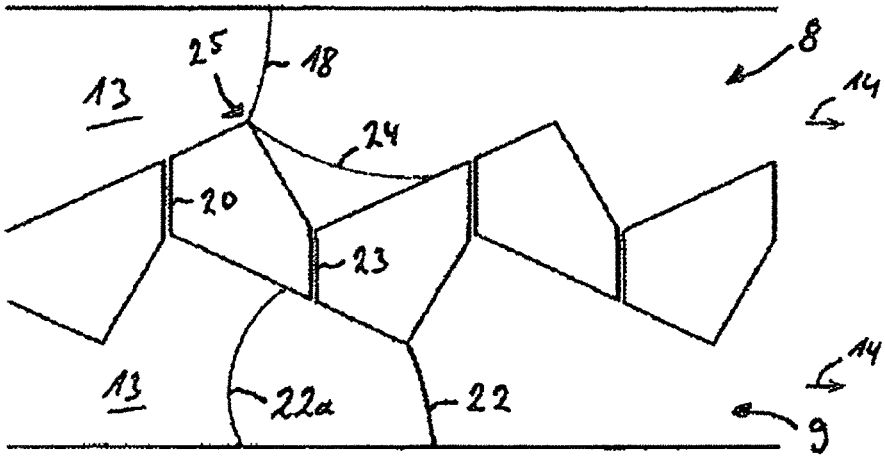
Figure 3:
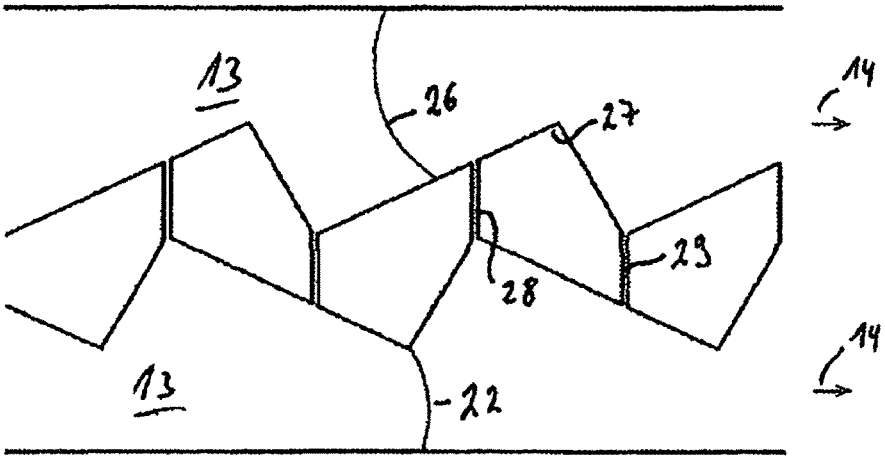
Figure 4:
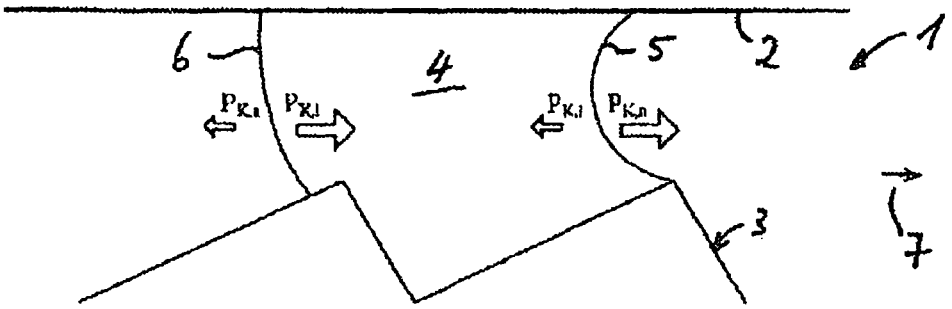
Fig. 4 (Prior art)
Figure 5:
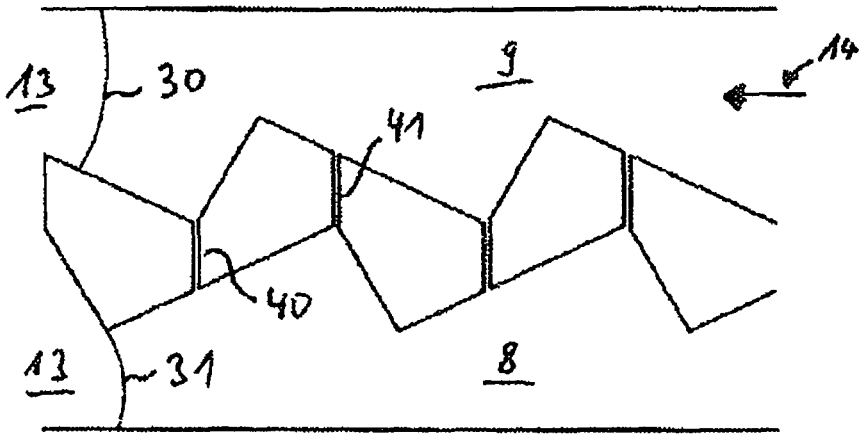
Figure 6:
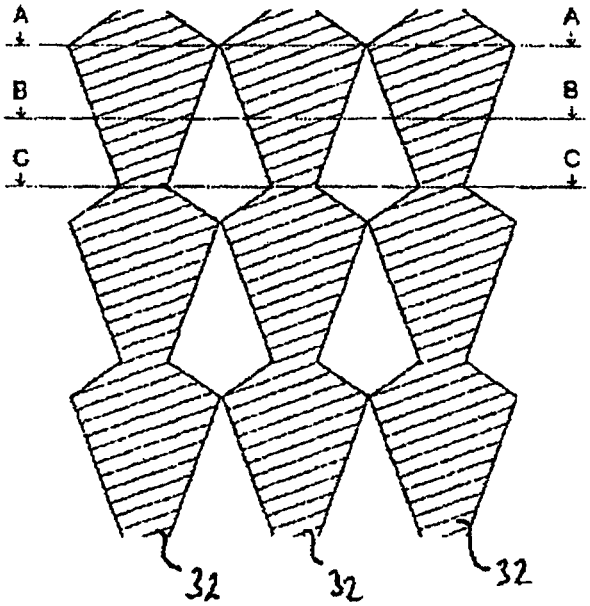
Figure 7:
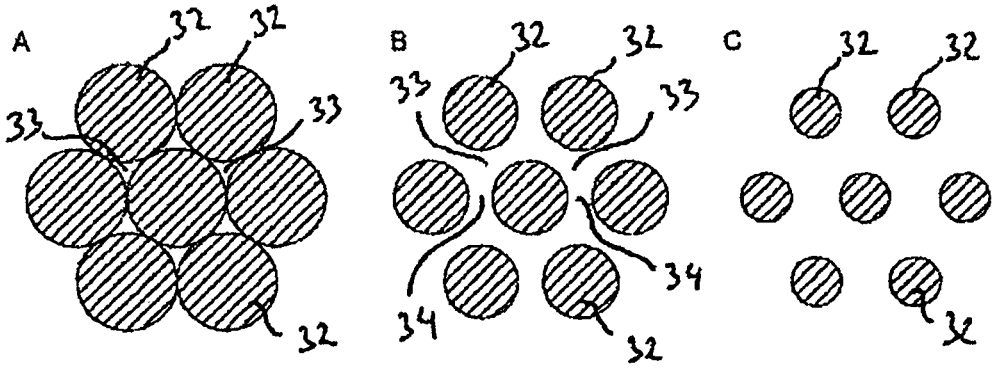
Figure 8:
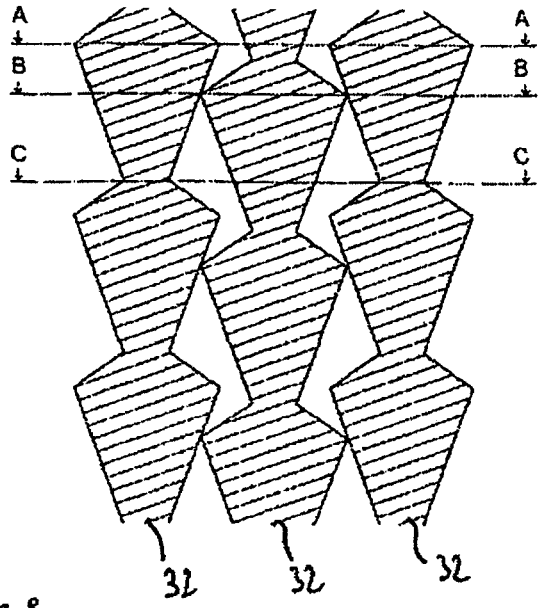
Figure 10:
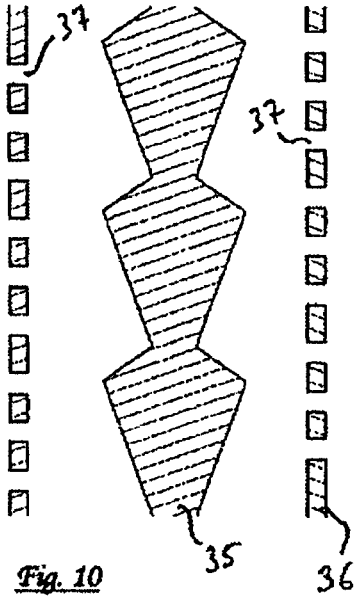
Figure 9:
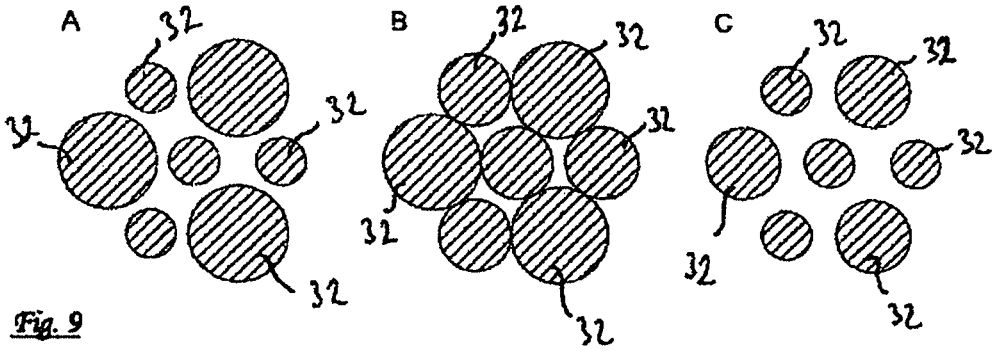
Figure 11:
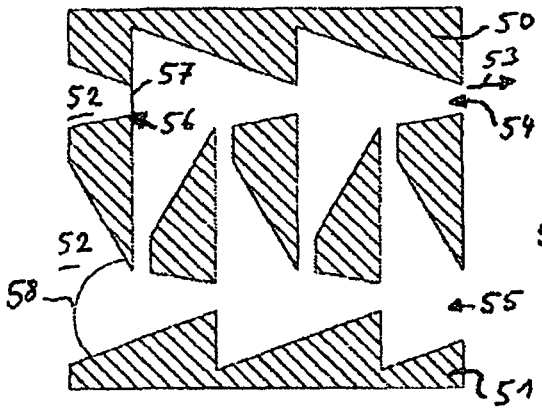
Figure 12:
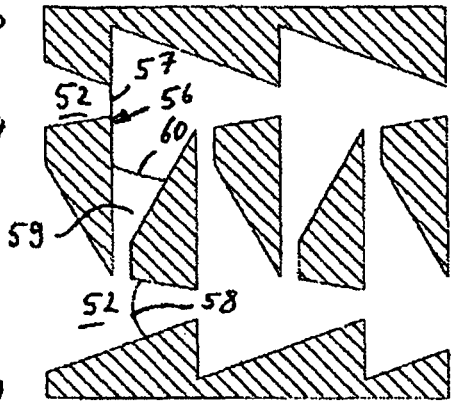
Figure 13:
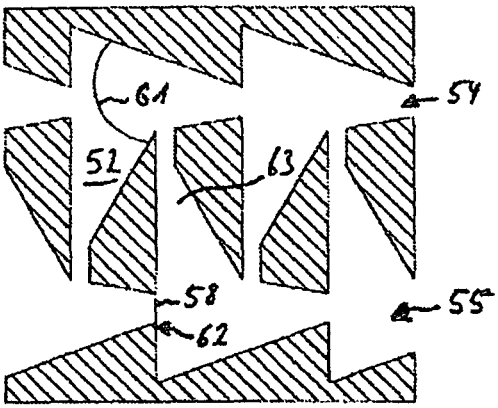
Figure 14:
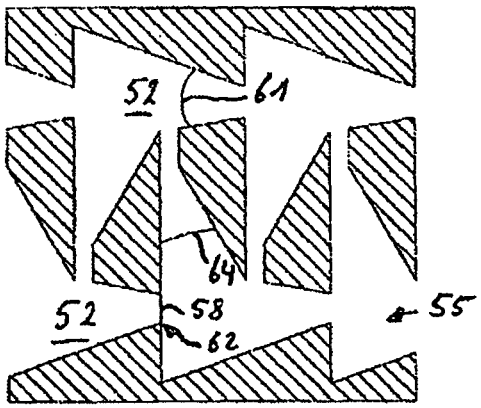

The respective figures show the following diagrammatically:

FIG. 1 shows a detail of a capillary structure according to the invention,

FIG. 2 shows the capillary structure from FIG. 1 with menisci that have progressed further, FIG. 3 shows the capillary structure from FIGS. 1 and 2 with menisci that have progressed further, FIG. 4 shows a sawtooth structure that is known from the prior art, within a capillary, FIG. 5 shows the capillary structure of FIGS. 1 to 3 in a mirror-image illustration, for clarifying the fact that backward transport of the liquid is inhibited, FIG. 6 shows in cross section a capillary structure that has been generated from fibers, FIG. 7 shows the capillary structure according to FIG. 6, in three different sections, FIG. 8 shows a further capillary structure of fibers, FIG. 9 shows the capillary structure according to FIG. 8 in three different sections, FIG. 10 shows a capillary structure comprising an inner fiber and an encasing fiber, FIG. 11 shows a capillary structure similar to FIG. 1, in a first stage of the liquid progress, FIG. 12 shows the capillary structure according to FIG. 1, in a second stage of the liquid progress, FIG. 13 shows the capillary structure according to FIG. 1, in a third stage of the liquid progress, and FIG. 14 shows the capillary structure according to FIG. 1, in a fourth stage of the liquid progress.

FIG. 4 shows an asymmetric surface structure, known in principle from the prior art and in this case having a one-sided sawtooth shape, of a capillary 1 having a smooth side wall 2 and a sawtooth-shaped side wall 3, between which there is located a drop of liquid 4. The geometry of the capillary results in different curvatures of a front liquid surface 5 and a rear liquid surface 6. At the front liquid surface 5 there is a pressure difference, wherein the pressure $P_{K,i}$ directed toward the interior of the drop is smaller than the outwardly directed pressure $P_{K.a}$. In the other direction, by contrast, the curvature is directed in opposition to this, and the outwardly directed pressure $P_{K.a}$ is smaller than the pressure $P_{K.i}$ directed into the interior of the drop. If no external forces are present, the pressure relationships have the result that the liquid is transported in capillary manner in the direction of transport (arrow 7), wherein transport continues until the drop 4 has adopted a stable position.

FIGS. 1 to 3 show diagrammatically and in cross section an embodiment of a capillary structure as may be provided in a device according to the invention.

FIG. 1 shows two capillaries which, in the text below, are designated the upper capillary 8 and the lower capillary 9. The properties "upper" and "lower" merely relate to the illustration in the drawing and not to a possible orientation of the capillary in space. This may be a partially open capillary structure having an upper side wall 10 and a lower side wall 11, between which there is arranged a middle structure 12. The capillary structure is downwardly delimited, perpendicular to the plane of the drawing, by a floor (not illustrated separately here). The capillary structure is open on the opposite side to the floor.

The manner in which a liquid mass 13 progresses within the capillary structure, from left to right in the direction of transport 14, is described below.

In the lower capillary 9, directed transport of the liquid mass 13 first runs as far as the corner point 15 of the middle structure 12. The corner. point 15, like every other corner point mentioned below, defines a respective stop point for the liquid transport in the capillary concerned.

Correspondingly, the liquid mass runs in the upper capillary 8, as a result of the interaction of the geometry and contact angle 16, as far as the corner point 25. For the respective end positions, the upper meniscus 18 is drawn in for the upper capillary 8 and the lower meniscus 19 is drawn in for the lower capillary 9. In addition, the position 18*a* of the meniscus 18 at an earlier stage is drawn in for the upper capillary 8.

In the end position drawn in with meniscus 18, the liquid mass 13 in the upper capillary 8 has already gone beyond the inlet of a passage channel 20 which connects the upper capillary 8 to the lower capillary 9. The passage channel 20 is itself also a capillary, and for this reason liquid from the liquid mass 13 moves out of the upper capillary and through the passage channel 20 to the lower capillary 9 as a result of capillary forces, and there forms a further meniscus 21 which runs as far as the corner point 15. At this point, the two menisci 19 and 21 are connected and combine to form a common new meniscus 22, as drawn in in FIG. 2, in an intermediate position 22*a* and a leading-edge end position 22. On the way to the leading-edge end position 22, the liquid mass 13 has flowed into a second passage channel 23 which in turn connects the lower capillary 9 to the upper capillary 8. The liquid from the lower liquid mass 13 runs through the passage channel 23 and into the upper capillary 8, as a result of the capillary forces, and there forms the further meniscus 24 which is combined at the corner point 25 with the further meniscus 18 to form a new common meniscus 26, which is illustrated in FIG. 3 on its way to the corner point 27. The described behavior of the liquid mass 13 continues through the further passage channels 28 and 29 such that the liquid mass 13 is transported further in the direction of transport 14.

This procedure is achieved for example by putting a drop of liquid on the open side of the capillary structure. FIG. 5 shows the capillary structure from FIGS. 1 to 3 in mirror image, such that the direction of transport 14 prevailing in FIGS. 1 to 3 has in this case to be illustrated running from right to left. In the direction opposed to the direction of transport 14, progress of the liquid mass 13 is reduced or inhibited, since the capillaries are widened in the region of the menisci 30 and 31 that are drawn in such that the menisci have a markedly smaller curvature or are given a straight or convex shape. Thus, the liquid mass 13 does not reach the passage channels 40 or 41 in this direction without the supply of external forces, or is at least slowed down, the result of this being that a directed transport of liquid is achieved by means of the capillaries 8 and 9. A drop of liquid which is put onto a structure of this kind or a plurality of such capillary structures is thus distributed solely or at least predominantly in the direction of transport 14.

The illustrative drawing in FIGS. 1 to 3 serves to schematically indicate the principle. FIGS. 11 to 14 illustrate a further variant on a capillary structure according to the invention which has been successfully tested in practice. Here, unlike the situation in FIGS. 1 to 3, outer side walls 50 and 51 are provided with asymmetric sequences of changes in cross section.

Transport of a liquid mass 52 runs in the direction of the arrow 53. The liquid mass 52 runs in the direction of transport 53 in an upper capillary 54 as far as a first stop point 56. A liquid meniscus 57 adopts a largely uncurved shape.

In a lower capillary 55, a lower branch of the liquid mass 52 forms a further meniscus 58 which is still pronouncedly concave (curved toward the liquid interior) in form and progresses in the direction of transport 53 in the lower capillary 55.

In FIG. 12, the lower branch of the liquid mass 52 with its meniscus 58 has progressed further because of the capillary forces and has passed the inlet of a passage channel 59, which is also capillary. In the passage channel 59 there is formed a further meniscus 60 which progresses in the passage channel 59 until it is combined with the meniscus 52 at the stop point 56 and forms the new meniscus 61 (FIG. 13). In the meantime, the meniscus 58 in the lower capillary 55 has reached the further stop point 62. The meniscus 61 that progresses because of the capillary forces passes the inlet to the further passage channel 63, as a result of which a further meniscus 64 forms there (FIG. 14), and this will combine with the meniscus 58 of the lower capillary 55 at the stop point 62. Progress of the mechanism described results in directed transport in the direction of transport 53.

An alternative capillary structure is shown in FIGS. 6 and 7, wherein the capillary structure is formed by fibers 32. In relation to a plane that is perpendicular to their longitudinal direction, the fibers have an asymmetric structure, the result of which is directed transport through the capillaries 33 formed between the fibers 32. In the sectional drawings "A", "B" and "C" in FIG. 7, the arrangement of fibers 32 in a tightly packed arrangement is clear. Moreover, the sectional drawings "B" and "C" illustrate passage channels 34.

Here too, the interaction between the capillaries 33 and the passage channels 34 provides for continuous progress of the liquid mass (not illustrated here) in a preferred direction, namely upward in FIG. 6.

The capillary structure in FIGS. 6 and 7 may be delimited by side walls, which are not illustrated here. The capillary structure may be partially open or closed.

FIGS. 8 and 9 illustrate an alternative arrangement of the fibers 32 in a more tightly packed arrangement, in an illustration corresponding to FIGS. 6 and 7. According to this, the fibers 32 are placed in relation to one another such that the asymmetry of the capillary cavities is increased. The tighter packing enables stop points to be overcome more easily by combining menisci.

FIG. 10 shows an outer hollow fiber 36 which encases an inner fiber 35 and has numerous openings 37 on its periphery. By this means, a further variant on a capillary structure may be formed by packing a plurality of such combinations of encasing hollow fiber 36 and inner fiber 35 into a bundle. Here, the openings 37 form the passage channels between adjacent capillaries. The number of openings 37 may also be selected to be markedly smaller than that illustrated in FIG. 10. The decisive point is that the function of passage channels according to the invention is fulfilled. Each inner fiber 35 may be a solid fiber as illustrated in FIG. 10, or a hollow fiber. A plurality of inner fibers 35 may also be provided in the hollow fiber 36.

| List of reference numerals | |
|---|---|
| 1 | Capillary |
| 2 | Side wall |
| 3 | Side wall |
| 4 | Drop of liquid |
| 5 | Front liquid surface |
| 6 | Rear liquid surface |
| 7 | Direction of transport |
| 8 | Upper capillary |
| 9 | Lower capillary |
| 10 | Side wall |
| 11 | Side wall |
| 12 | Middle structure |
| 13 | Liquid mass |
| 14 | Direction of transport |
| 15 | Corner point |
| 16 | Contact angle |
| 18 | Upper meniscus |
| 18a | Meniscus |
| 19 | Lower meniscus |
| 20 | Passage channel |
| 21 | Meniscus |
| 22 | Meniscus in end position |
| 22a | Meniscus in intermediate position |
| 23 | Passage channel |
| 24 | Meniscus |
| 25 | Corner point |
| 26 | Meniscus |
| 27 | Corner point |
| 28 | Passage channel |
| 29 | Passage channel |
| 30 | Meniscus |
| 31 | Meniscus |
| 32 | Fiber |
| 33 | Capillary |
| 34 | Passage channel |
| 35 | Inner fiber |
| 36 | Hollow fiber |
| 37 | Opening |
| 40 | Passage channel |
| 41 | Passage channel |
| 50 | Side wall |
| 51 | Side wall |
| 52 | Liquid mass |
| 53 | Direction of transport |
| 54 | Upper capillary |
| 55 | Lower capillary |
| 56 | Stop point |
| 57 | Meniscus |
| 58 | Meniscus |
| 59 | Passage channel |
| 60 | Meniscus |
| 61 | Meniscus |
| 62 | Stop point |
| 63 | Passage channel |
| 64 | Meniscus |

The invention claimed is:

1. A device for the directed capillary transport of liquids, said device comprising at least two capillaries each having at least one side wall, wherein said at least two capillaries are formed such that a passive directed capillary transport of the liquid is performed at least in certain regions, and at least one capillary passage channel wherein said at least two capillaries are connected to one another in the direction of transport of the liquid by said at least one capillary passage channel, wherein at least two of said capillaries each have a plurality of transport sections which, as seen in the direction of transport, succeed one another and provide for passive directed capillary transport over the entire transport section, wherein at least two of said transport sections end in a stop point which is operable to interrupt said passive directed transport of liquid, and wherein at least one of said at least one passage channel has a channel outlet positioned downstream of the stop point, as seen in the direction of transport, and adjacent to said stop point.

2. The device claimed in claim 1 wherein at least one of said at least one transport section has a cross section of the capillary which is reduced in the direction of transport.

3. The device claimed in claim 2 wherein at least some of said directed capillary transport is brought about by a material of at least one of said capillary side walls.

4. The device claimed claim 1 wherein at least some of said directed capillary transport is brought about by a material of at least one of said capillary side walls.

5. The device claimed in claim 1 wherein at least one of the stop points is formed by an enlarged transport cross section.

6. The device as claimed in claim 1, wherein at least one of the stop points is formed by a change in the surface material of at least one of said capillary side walls.

7. The device claimed in claim 1 wherein at least some of said at least two capillaries have a sponge-like structure.

8. The device claimed in claim 1 wherein at least one of said at least two capillaries is formed by a fiber material.

9. The device claimed in claim 8 wherein at least one of said at least two capillaries comprises at least one hollow fiber.

10. The device as claimed in claim 9 further comprising an inner capillary structure surrounded by at least one of said at least one hollow fiber.

11. The device claimed in claim 1, wherein at least one of said at least two capillaries is partially open.

12. The device claimed in claim 11 wherein at least one of said at least one partially open capillary is part of a surface.

13. The device claimed in claim 11 wherein at least one of said at least two capillaries is formed by a fiber material.

14. The device claimed in claim 13 wherein at least one of said at least two capillaries is formed by at least one hollow fiber.

15. The device claimed in claim 14 further comprising an inner capillary structure surrounded by at least one of said at least one hollow fiber.

16. A device for the directed capillary transport of liquids, said device comprising at least two capillaries each having at least one side wall, wherein said at least two capillaries are formed such that a passive directed capillary transport of the liquid is performed at least in certain regions, and at least one capillary passage channel wherein said at least two capillaries are connected to one another in the direction of transport of the liquid by said at least one capillary passage channel, wherein at least two of said capillaries each have a plurality of transport sections which, as seen in the direction of transport, succeed one another and provide for passive directed capillary transport over the entire transport section, wherein at least two of said transport sections end in a stop point which is operable to interrupt said passive directed transport of liquid, and wherein at least one of said at least one passage channel has a channel outlet positioned downstream of the stop point of a first one of the at least two capillaries, as seen in the direction of transport, and adjacent to said stop point wherein a stoppage of the liquid at said stop point is overcome by the supply of liquid from a second one of the at least two capillaries by way of said passage channel.

17. The device claimed in claim 16 wherein at least one of said at least one transport section has a cross section of the capillary which is reduced in the direction of transport.

18. The device claimed in claim 16 wherein at least one of said at least two capillaries is formed by a fiber material.

19. The device claimed in claim 16, wherein at least one of said at least two capillaries is partially open.

20. The device claimed in claim 19 wherein at least one of said at least two capillaries is formed by a fiber material.

* * * * *